US005957824A

United States Patent [19]

Lerner et al.

[11] Patent Number: 5,957,824

[45] Date of Patent: Sep. 28, 1999

[54] BAGS AND METHOD OF MAKING BAGS

[75] Inventors: Bernard Lerner, Aurora; William M. Cronauer, Tallmadge, both of Ohio

[73] Assignee: Automated Packaging Systems, Inc., Streetsboro, Ohio

[21] Appl. No.: 08/454,374

[22] PCT Filed: Oct. 6, 1994

[86] PCT No.: PCT/US94/11346

§ 371 Date: Jun. 6, 1995

§ 102(e) Date: Jun. 6, 1995

[87] PCT Pub. No.: WO95/09727

PCT Pub. Date: Apr. 13, 1995

Related U.S. Application Data

[63] Continuation-in-part of application No. 08/133,639, Oct. 7, 1993, Pat. No. 5,417,639.

[51] Int. Cl.[6] ..... B31B 27/00

[52] U.S. Cl. ..... 493/267; 493/380

[58] Field of Search ..... 493/194–197, 493/198, 210, 212, 223, 224, 238, 346, 380, 189, 193, 208, 209, 230, 231, 233, 251, 254

[56] References Cited

U.S. PATENT DOCUMENTS

| | | | |
|---|---|---|---|
| 2,347,439 | 4/1944 | Shea et al. | 493/194 |
| 2,392,206 | 1/1946 | Waters | 493/189 |
| 2,773,285 | 12/1956 | Piazze et al. | 206/390 |
| 2,880,925 | 4/1959 | Klasing et al. | 383/106 |
| 3,027,065 | 3/1962 | Lindquist et al. | 383/37 |
| 3,060,075 | 10/1962 | Kincaid . | |
| 3,254,468 | 6/1966 | Lerner | 383/37 |
| 3,254,828 | 6/1966 | Lerner | 229/53 |
| 3,448,555 | 6/1969 | Shabram | 383/37 |
| 3,533,331 | 10/1970 | Kugler | 493/194 |
| 3,679,127 | 7/1972 | Stefancin | 493/189 X |
| 3,682,051 | 8/1972 | Sengewald | 206/390 |
| 3,765,597 | 10/1973 | Brieske | 383/106 |
| 3,990,625 | 11/1976 | Jelling et al. | 206/390 |
| 4,014,154 | 3/1977 | Lerner . | |
| 4,201,029 | 5/1980 | Lerner et al. . | |
| 4,232,589 | 11/1980 | Ernst . | |
| 4,306,656 | 12/1981 | Dahlem . | |
| 4,337,058 | 6/1982 | Lerner | 493/238 |
| 5,215,275 | 6/1993 | Gold . | |
| 5,221,567 | 6/1993 | Baker | 493/189 X |
| 5,341,625 | 8/1994 | Kramer . | |

FOREIGN PATENT DOCUMENTS

| | | |
|---|---|---|
| 2241405 | 3/1975 | France . |
| 1934041 | 2/1971 | Germany . |

*Primary Examiner*—Joseph J. Hail, III
*Assistant Examiner*—Anthony Ojini
*Attorney, Agent, or Firm*—Watts, Hoffmann, Fisher & Heinke Co., L.P.A.

[57] ABSTRACT

Methods of making a container strip in the form of a chain of interconnected preopened bags with openings preferably having longitudinal dimensions of at least about 1/64 inch is disclosed. The container strip provides greatly enhanced facility for bag registration and opening during packaging operations utilizing the improved container strip. Processes of forming a chain of preopened bags are also disclosed. Face and back plastic webs are fed along individual paths of travel to a common path. In one embodiment the webs are differentially tensioned while in their independent paths by stretching the face web more than the back web such that the face web will retract longitudinally more than the back web upon release of the web tension. While so tensioned edge seals are formed between the webs to convert the webs into a tube and longitudinally spaced transverse seals are formed between the webs to delineate bottoms of bags. Transverse lines of weakness are formed in the back web to facilitate separation of bags from the remainder of the web during a subsequent use. Tension in individual bag sections of the face web is released by forming longitudinally spaced transverse separations of the sections and thereby producing a space between each contiguous pair of sections. In other embodiments pairs of transverse lines of severance are formed in a front section of the webs and parts between the lines of severance are removed to form the novel bags without the need for differential stretching.

25 Claims, 3 Drawing Sheets

BAGS AND METHOD OF MAKING BAGS

REFERENCE TO RELATED APPLICATIONS

This is a continuation-in-part of Ser. No. 08/133,639, filed Oct. 7, 1993, entitled BAGS AND METHOD OF MAKING SAME now U.S. Pat. No. 5,417,639, issued May 23, 1995 (The Parent Case).

This invention relates to chains of interconnected, pre-opened bags used in packaging and more particularly relates to a novel and improved method of making chains of bags.

BACKGROUND OF THE INVENTION

U.S. Pat. No. 3,254,828, issued Jun. 7, 1966, to Hershey Lerner under the title Flexible Container Strips is directed to so called bags on a roll (here the AutoBag patent). This patent discloses a web of bags interconnected by lines of weakness, preferably in the form of perforations, with each of the bags being open on one face. In use the bags are sequentially fed to a loading station. When at the loading station, each bag is blown open, a product is inserted and thereafter separated from the web and, if desired, the bag is then sealed to form a package.

These container strips in the form of chains of pre-opened bags are supplied either on a roll as taught in the AutoBag patent or festooned in a carton in the manner taught in U.S. Pat. No. 4,201,029, issued May 6, 1980, to Bernard Lerner et al. under the title Method and Apparatus for Packaging, (here the Wig-Wag patent). Such container strips have been sold by Automated Packaging Systems, Inc. of Streetsboro, Ohio, the assignee of the present case, under the trademark AutoBag and have enjoyed great commercial success.

Both AutoBag and competitive products have usually been made by feeding a tube through a converting machine. Such a machine forms transverse seals to delineate the bottoms of the bags and transverse lines of weakness by perforating both layers of the tube to delineate contiguous ends of adjacent bags. After the perforations are formed, a "zinging" operation is performed on each bag to open the front of the bag while leaving the perforations of the back intact.

Relatively recently a market has developed for these chains of bags made from two layers of plastic, so that the plastic of the front of the bag is different from that of the back of the bag. For example, some customers for such bags may wish the back of the bag to be white to enhance the legibility of information imprinted on it such as instructions on how to use a product packaged in the bag. The front of the bag is clear, so that the contents of a package are readily visible. To accomplish this two single layer webs of plastic are fed from respective supplies in a manner similar to that taught in U.S. Pat. No. 4,337,058 issued Jun. 29, 1982 to Bernard Lerner under the title Method of Making a Container Strip Having Inserts. Marginal edges of the two webs are then fused together to form a tube and remainder of the container strip manufacture is identical to that when the supplied work piece is a flattened tube.

So called "multiple up" production has also become quite customary. With multiple up, the work piece may be either a relatively wide flattened tube, or two relatively wide single ply sheets fed together and fused. In either event hot knives are used to sever the work piece into two or more elongate tubes and thereafter each new tube is made into a chain of pre-opened bags.

When bags are made from two single ply webs, every effort has been made to provide identical tension on the two webs, so that once made into a tube the only difference of the tube from one provided as a tubular work piece is that the front and back are not identical, such as the back may be pigmented while the front is clear. With the two single ply approach, if the bag making machine was not adjusted properly, once opened the bags would not lie flat with the separated edges which delineate the openings lying in closely juxtaposed positions. The resultant product was often scrap. If the edges were not juxtaposed but rather there was a gap between them, these "gap" bags were rejected because they were perceived to be unacceptable to customers as unsightly and bags which would produce packages with malaligned top edges. If the top edge of an opened bag overlapped the bottom of the adjacent bag, they were not subject to a policy of universal rejection as were the gap bags but all too often the spark gap detector used for bag registration in a bagging machine would not function properly. Such a bagging machine is disclosed in U.S. Pat. No. 4,014,154, issued Mar. 29, 1977, to Bernard Lerner and related patents identified therein (here the H-100 patents).

SUMMARY OF THE INVENTION

As taught in the Parent Case, it has now been recognized for the first time that if chains of bags are made from single ply webs that are differentially tensioned an improved and superior product can be produced.

The improved product is a flexible container strip formed of an elongated flexible tube of plastic material capable of bonding to itself at a predetermined temperature on application of pressure but being otherwise non-adherent to material of identical composition. The tube is longitudinally collapsed with face and back plies joined together along their longitudinal side edges. A plurality of spaced, transversely disposed bottom seals each secure the plies together and delineate ends of fillable bag spaces. Each seal extends transversely from one side edge of the tube to another such that the tube is separated into a chain of connected bags. The face ply of each bag has a transverse end opening extending substantially from one side edge of the bag to the other and extending longitudinally a distance sufficient to facilitate bag opening and loading and to provide detection access to aligned lines of weakness in the back ply. Each opening is adjacent the end of the bag remote from its bottom seal forming the filling space end of that bag such that the bags of the chain are all oriented in the same direction.

The openings all formed in the face ply and are at longitudinally spaced intervals equal to the spacing of the bottom seals. The back ply of each bag has a transversely weakened tearable portion extending substantially from one side edge to another to permit facile separation of the bags while maintaining the integrity of the back ply and the tube. Each tearable portion is aligned with and accessible through the end opening of its bag. Thus, the improved strip is a chain of collapsed bags which may be fed serially along a path from a supply to bag opening and load stations, may be readily and accurately registered at a load station through spark detector location of the tearable portions and may be opened by a blast of air directed longitudinally of the path and then loaded and separated from the chain sequentially and one at a time.

In the preferred method of manufacture of the Parent Case the tension on the web which will become the face of the bags is carefully differentially tensioned to stretch it, without exceeding its elastic limit, more than the web which will become the back of the bags. Alternatively the back web is tensioned more than the front and the back to exceed its elastic limit. While the differential tensioning is maintained, side seams are formed to produce a tube. Preferably the balance of the container strip formation operation is that which has been employed in the past, so that existing manufacturing equipment can be used without modification.

With the preferred process of the Parent Case, the improved product results when the face of a bag is "zung" to form a transverse opening delineating the top of the bag. The formation of the opening releases the tension in the face of the bag, so that the face of the bag will shrink relative to the back with the result that the top edge of the just opened bag will be at least about 1/64 (one sixty fourth) of an inch from the bottom edge of the following adjacent bag. The resultant product not only facilitates bag opening at a load station, but also assists in reliably producing appropriate bag registration at a load station. Registration is enhanced because the perforations in the back face, being aligned with and accessible through the elongated opening, are readily, precisely and reliably detected by a spark detector.

In an alternate system for making the improved chain of bags, bottom seals and perforations are formed and the web is "zung" to separate perforations of the face web. Thereafter side seals are formed while the back web is maintained under controlled tension to produce bags having top openings of consistent and desired longitudinal extent.

The process of this invention includes feeding face and back plastic web sections along respective paths of travel and as they are fed forming transversely extending lines of weakness in the back section. Spaced pairs of transversely extending lines of severance are formed in the front section at longitudinally spaced intervals corresponding to the spacing of the lines of weakness. The sections are superposed with the lines of severance positioned with an associated one of the lines of weakness longitudinally located between the lines of severance of the associated pair. Transverse seals are formed between the sections at least some of which delineate bag bottoms each near a line of weakness and its associated pair of lines of severance. A side edge seal is formed between the sections which is spaced from a second side edge delineated by a selected one of a longitudinally extending fold or a second side edge seal. Bag openings are formed by removing portions of the face section between the lines of severance of each pair.

The spacing of the lines of severance of each pair is sufficient to assure that the associated line of weakness may be readily detected as by a spark gap detector when the lines of weakness are perforations. Preferably the spacing of the lines of severance is at least about 1/64 inch.

As suggested previously the sections may be either independent, separate webs or alternately formed by a single wide web folded to produce the two sections. Optionally, the face section may be in the form of a series of independently precut portions which are secured to the back section with each portion forming the front of an individual bag of the chain of bags being formed.

With all of the options, although the sections may be folded from a single web, it is considered that prior to juxtaposing the sections together the face and back sections traverse respective paths of travel and following juxtaposition the sections traverse a common path of travel.

Accordingly, the objects of the invention are to provide a novel and improved methods of making chains of interconnected but pre-opened bags.

IN THE DRAWINGS

DESCRIPTION OF THE PREFERRED EMBODIMENTS

Figure 4:
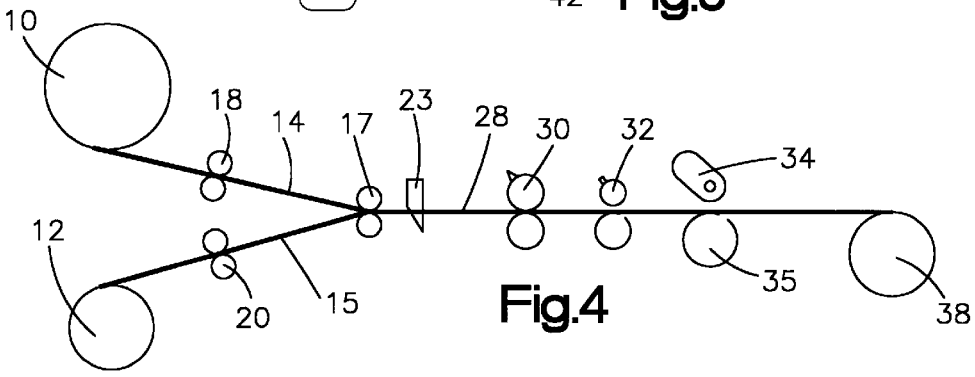
FIG. 4 is a side elevational, schematic view of a process of making a chain.
Figure 5:
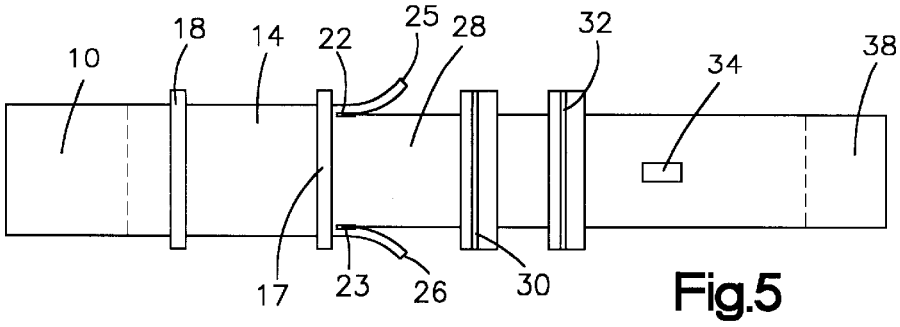
FIG. 5 is a schematic plan view of the machine of FIG. 4.

Referring now to the drawings and to FIGS. 4 and 5 in particular where the process of The Parent Case is shown. With this process, a pair of single ply individual web supplies 10, 12 are provided which are face and back webs respectively. Webs from the supplies 10, 12 are respectively fed along individual paths of travel 14, 15 to a juncture at juncture nip rolls 17. Tension control nip roll sets 18, 20 are provided. The set 18 is positioned along the path 14 to tension the face web 10 while the set 20 is along the path 15 to tension the back web 12. When in operation the nip roll set 18 will be set to tension the face web to a higher level than the back web, in that the web from the supply 10 will form the face of fronts of bags being produced.

The webs are fed from the juncture nip rolls 17 along a common path of travel 28. Hot knives 22, 23 are positioned downstream from the juncture nips 17 to form bead seals along side edges of the webs and convert the webs into a tube. Trim strips 25, 26 formed by the hot knives are removed for collection and recycling.

Once formed into a tube the combined webs pass through a sealer 30 which forms transverse seals to become the bottoms of the bags being produced. Next a perforator 32 forms transverse lines of weakness in the tube to delineate, in each case, a bag bottom adjacent a transverse seal and the top of an adjoining bag.

A rotating finger known as a "zinger" 34 is provided. The zinger has a surface speed slightly greater than the speed of the web so that as the zinger 34 strikes a section of the web that will be the front of a bag, acting against the resistance of an anvil roll 35, it separates the perforations of the front web to form a bag opening. Thereafter the web, now formed into a container strip of interconnected but open bags, is collected at a take up 38. Apart from the adjustment of the tension control nips 18, 20 to provide differential tensioning, the machine and the process thus far described are now conventional and well known to those in the art.

Figure 1:
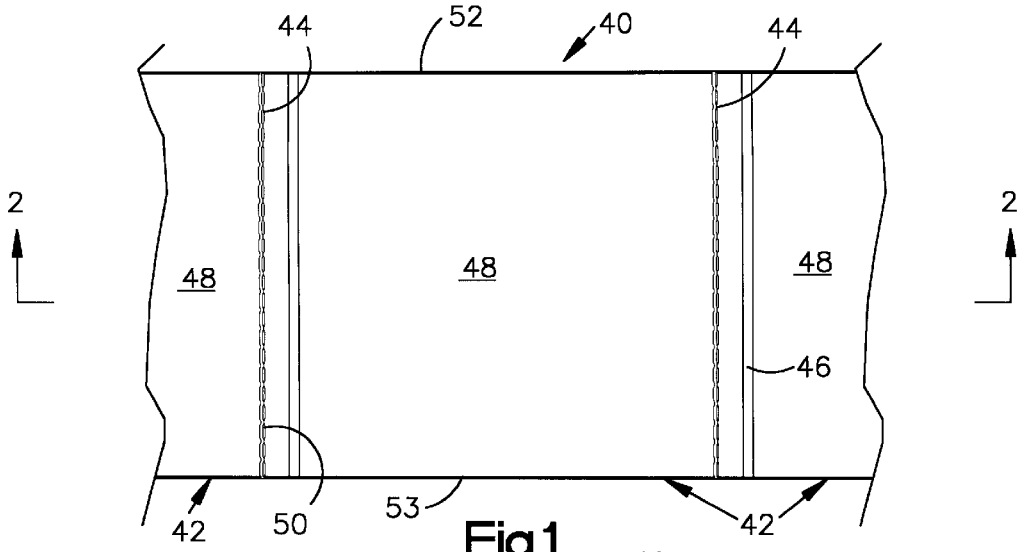
FIG. 1 is a fragmentary plan view of a section of a chain of interconnected bags made in accordance with invention.
Figure 2:
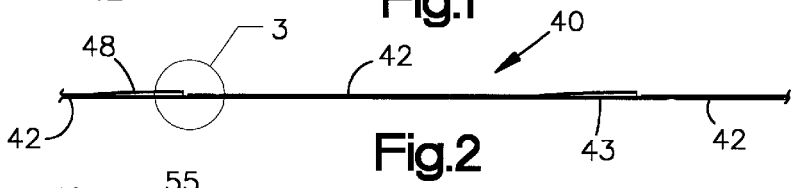
FIG. 2 is a sectional view of the chain of FIG. 1 as seen from the plane indicated by the line 2—2 of FIG. 1.
Figure 3:
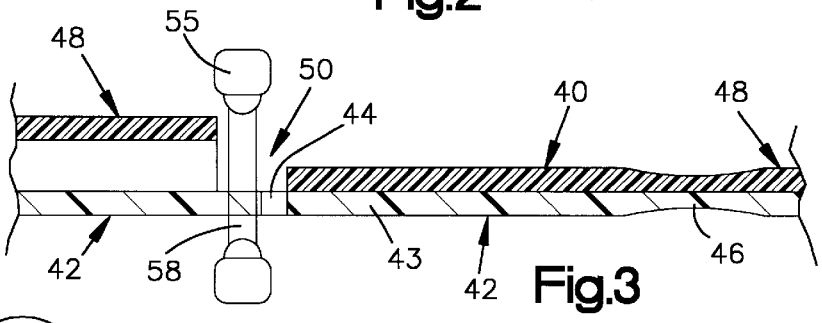
FIG. 3 is an enlarged sectional view of a section of the chain indicated by the circle 3 of FIG. 2.

Referring now to FIGS. 1 through 3, the novel container strip of The Parent Case is shown generally at 40. The strip includes a plurality of interconnected bags 42 joined together in a back ply 43 by lines of weakness 44 in the form of perforations. Transverse seals 46 delineate the bottoms of bags.

The face ply formed by the web from the supply 10 is separated into individual bag face sections 48. A transversely extending bag opening 50 is adjacent the top of each bag face section 48. Each opening 50 extends completely across the web from one side edge 52 to the other 53, while the perforations in the back 43 remain intact. Each bag opening extends longitudinally of the web preferably at least 1/64 (one sixty fourth) of an inch.

The importance of the longitudinal extent of these openings is best understood by reference to FIG. 3. A conventional spark detector is shown schematically at 55. Assuming the web is moving from right to left in FIG. 3 so that the bags are being fed closed end first in a bagging machine, as is conventional, it will be seen that the detector 55 will readily be able to locate the perforations 44 once the spark path indicated schematically at 58 is aligned with the perforations.

Figures 6, 7:
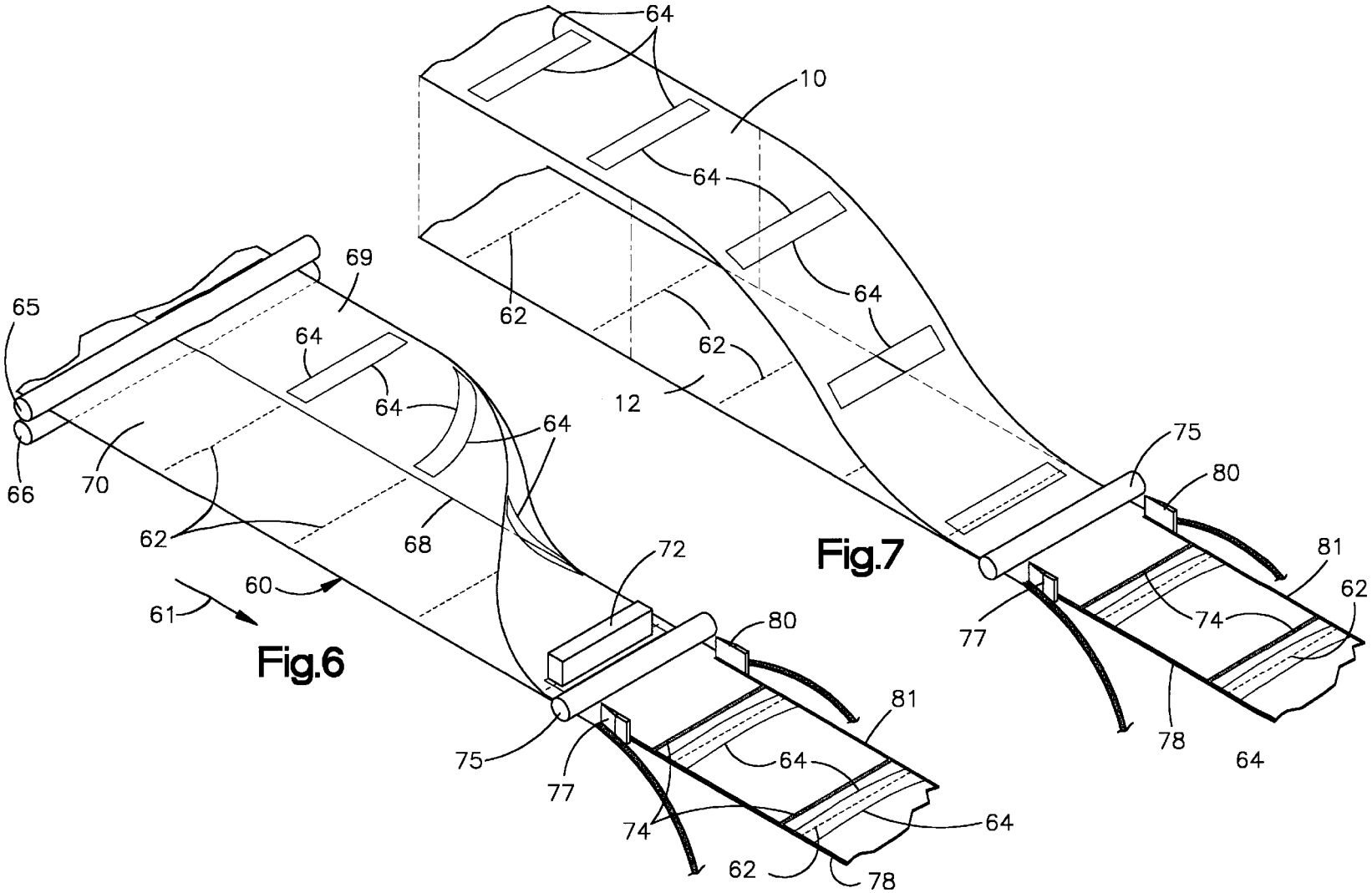
FIG. 6 is a schematic perspective view of a method of forming a chain of bags from a single web in which the web sections are joined by a fold.
FIG. 7 is a schematic perspective view of a method of forming a chain of interconnected bags from independent sections; and, FIG. 8 is a schematic perspective view of a method of forming bags from independent web sections wherein the face section is severed into independent portions prior to securement to the back section.

Referring now to FIG. 6, a web 60 is fed along a path of travel indicated by an arrow 61. Transverse lines of weakness in the form of perforations 62 and spaced pairs lines of severance 64 are shown as concurrently formed in the web. The lines of weakness and severance are formed by coacting cutting and anvil rolls 65, 66.

As the web 60 proceeds along its path of travel a fold 68 is formed in a known manner as by a well known V board. Through the folding process a face section 69 of the web 60 is superposed over a back section 70.

The parts of the base section 69 between each of the pairs of lines of severance 64 is removed as by a vacuum head shown schematically at 72 to produce a bag opening aligned with and superposed over an associated line of weakness 62.

Transverse seals 74 are formed by a heat sealer shown schematically at 75. Each of the seals shown in FIG. 6, delineates a bottom of one of the chain of bags being formed. A hot knife 77 forms a bead seal 78 along the web side edge opposite the fold 68 to complete the chain of bags. Optionally a second hot knife 80 may form an opposed bead seal 81 to assure that the openings delineated by the lines of severance 64 extend fully from one side edge to the other of each bag, if that is desired. Alternatively, the lines of severance may extend to the fold and use of the second hot knife 80 is not required.

Referring now to FIG. 7, face and back webs 10, 12, as in the embodiment of FIGS. 4 and 5, are fed along individual paths. Lines of weakness 62 and lines of severance 64 are respectively formed in a manner similar to the embodiment of FIG. 6 but with separate cutter and anvil rolls (not shown) rather than the dual cutter and anvil rolls 65, 66 of FIG. 6. Thereafter, they are juxtaposed and the transverse seals 74 and the bead seal 78, 81 are formed in a manner corresponding to the embodiment of FIG. 6.

Figure 8:
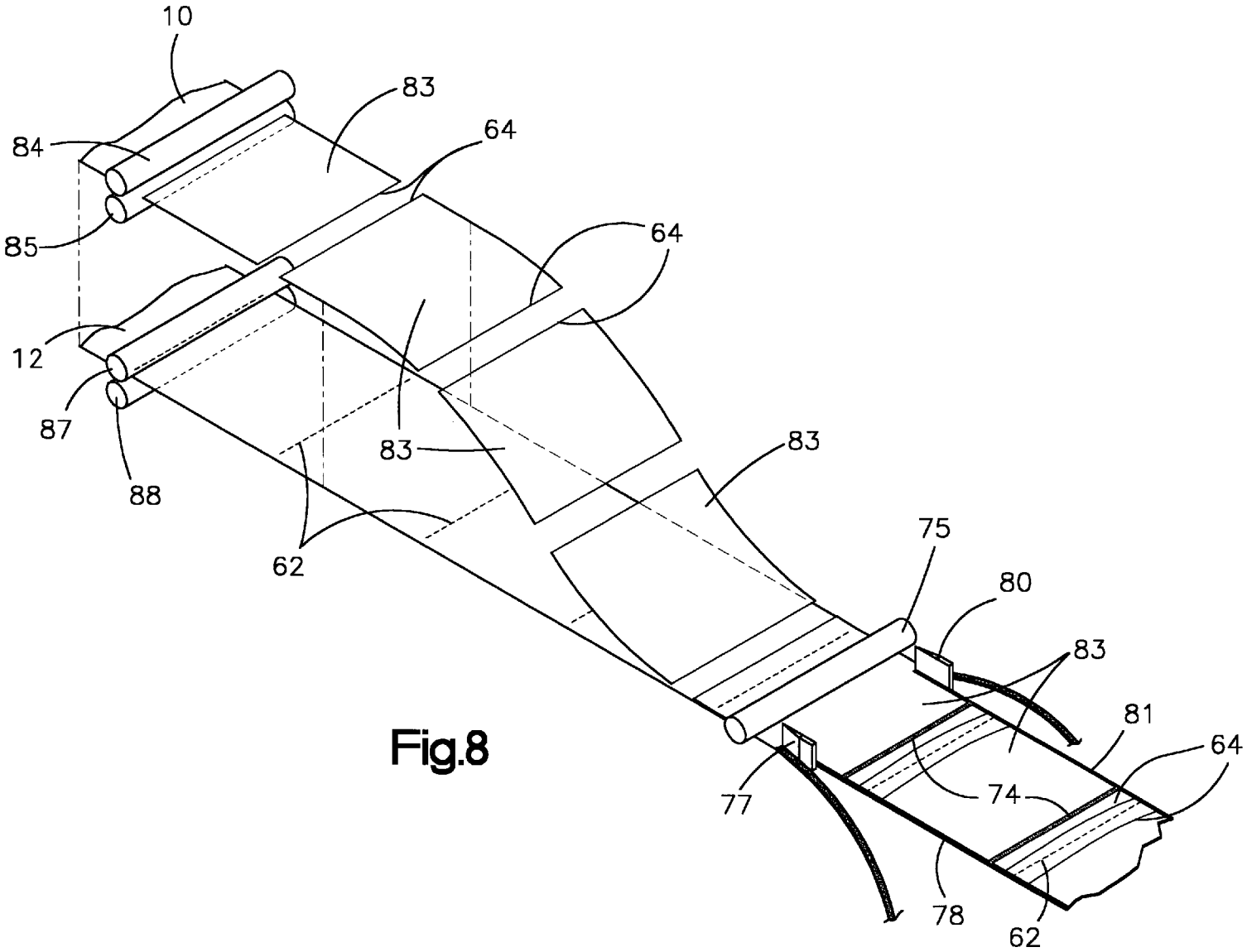

With the embodiment of FIG. 8, the upper face section 10 is severed into individual parts 83 by cutter and anvil rolls 84, 85 which form lines of severance 64 extending across the full width of web. Thereafter the individual parts 83 are suitably fed by a conventional mechanism, not shown, into juxtaposition with the back web 12. Transverse lines of weakness 62 are formed in the back web by coacting cutter and anvil rolls 87, 88, shown at a location prior to web juxtaposition but they may be located at down stream locations along the path of travel. Once the parts 83 are juxtaposed with the back web 12, the transverse seals 24 and the bead seals 78, 81 are formed in the manner described in connection with FIG. 6.

OPERATION

In operation as depicted in FIGS. 4 and 5, coils of single ply plastic are mounted to provide the front and back supplies 10, 12. The materials of the webs may be other than identical so long as they are capable of being sealed together. For example, one web may be pigmented such that it is translucent or opaque while the other web is clear. Typically the plastic will be polyethylene, although other thermal softenable plastics capable of adherence together on application of heat and pressure are sometimes employed.

Webs from the supplies 10, 12 are fed along their respective independent paths of travel through the tension control nip rolls 18, 20 to the juncture nips 17. They are then fed along the path 28 past the hot knives 22, 23, the transverse sealer 30, the perforator 32, the zinger 34 and thence to the take up 38.

Once the machine is set up and operation commences and the nips 18, 20 are adjusted to provide differential tension along the paths 14, 15. The appropriate tension is a function of the material, its thickness and its width.

Once appropriate tension has been at least provisionally established and temperatures of the hot knives and transverse sealer are adjusted to appropriate levels, production commences. Tension is further adjusted as the machine operates until desired finished products are consistently produced. During production the two plies are fed past the hot knives to create a tube with a front face stretched more than the back. This differential stretching is maintained as the now formed tube passes the transverse sealer and the perforator. Once the face web is opened by the zinging operation, the tension in the just opened web face section is released and it will shrink longitudinally of the web relative to the back preferably to produce the desired opening of at least 1/64 (one sixty fourth) of an inch measured longitudinally of the web.

With the embodiments of FIGS. 6–8, relative tension of the web sections is not critical in that bag openings of sufficient width are formed by producing the pairs of lines of severance 74 in each of those embodiments in the manner described. In the three embodiments shown once the lines of severance 64 and the lines of weakness 62 are formed, the front and back sections are juxtaposed. Thereafter, the bead seals 78 and the transverse seal 74 are formed. While in each embodiment the schematic drawings depict the formation of the transverse seals before the bead seals, the sequence can obviously be reversed. Similarly, removal of web parts between lines of severance is shown in FIG. 6 to occur as the webs are juxtaposed, but this operation may also be performed at other locations along the path of travel. After juxtaposition of the front and back sections, the bead seal 81 is formed in the embodiments of FIGS. 7 and 8 and may be formed in the embodiment of FIG. 6 if desired. With all three embodiments, a chain of bags is produced in which each bag opening, as in the embodiment depicted in FIGS. 4 and 5, has sufficient longitudinal extent to assure facile detection of the associated line of weakness.

Although the invention has been described in its preferred form with a certain degree of particularity, it is understood that the present disclosure of the preferred form has been made only by way of example and that numerous changes in the details of construction, operation and the combination and arrangement of parts may be resorted to without departing from the spirit and the scope of the invention as hereinafter claimed.

We claim:

1. A process of making a chain of interconnected, pre-opened plastic bags comprising:

a) feeding face and back plastic web sections along respective paths of travel;

b) forming at least one longitudinally extending first bag side edge seal opposite and spaced from a second side edge delineated by a selected one of a longitudinally extending side fold and a longitudinally extending second side edge seal;

c) forming spaced, parallel, transversely extending lines of weakness in the back section, the lines of weakness extending substantially continuously from the first side edge to the second side edge whereby to provide edge to edge support for each such bag when a product is loaded into it;

d) forming spaced pairs of transversely extending, spaced lines of severance in the front section at longitudinally spaced intervals corresponding to the longitudinal spacing of the lines of weakness;

e) superposing the sections with each pair of lines of severance positioned with an associated one of the fines of weakness longitudinally located between the lines of severance of an associated pair of the lines of severance;

f) forming spaced, transverse seals between the sections at least certain of the transverse seals delineating bag bottoms each near a line of weakness and its associated pair of lines of severance and extending substantially from the first side edge to the second side edge; and, g) forming bag openings by removing portions of the face section, the portions extending from the first side edge to the second and being between the lines of severance of each pair and each opening extending longitudinally in both directions from the associated line of weakness whereby to facilitate detection of the lines of weakness during a subsequent packaging operation.

2. The process of claim 1 wherein the second side edge is delineated by a fold.

3. The process of claim 1 wherein the second side edge is delineated by a second edge seal.

4. The process of claim 1 wherein at least certain of the lines of severance are perforations.

5. The process of claim 1 wherein at least certain of the lines of severance are cuts.

6. The process of claim 1 wherein the portions are removed before the sections are superposed.

7. The process of claim 1 wherein the portions are removed after the sections are superposed.

8. The process of claim 1 wherein the lines of severance of each pair are at least about 1/64 inch apart.

9. A process of forming a chain of interconnected plastic bags comprising:

a) feeding an elongate, plastic web along a path of travel through a bag formation machine; and, b) converting the web into interconnected bags by preforming the following steps:

I) securing at least one marginal edge portion of each of a plurality of spaced bag fronts along a longitudinally extending portion of the web to delineate a first side of the chain of bags being formed;

ii) providing a second marginal edge to delineate a second side of the chain of bags in spaced, longitudinally extending relationship with said first side;

iii) the fronts being positioned in spaced relationship with one another to delineate a bag opening between each successive pair of fronts;

iv) further securing the bag fronts to the web by forming transverse bag bottom seals each between a different one of the fronts and the web whereby to delineate the bottom of each bag of the chain being formed; and, v) delineating bag ends by forming transverse lines of weakness in the web each at a location longitudinally between two successive fronts and aligned with an associated opening such that each line of weakness is readily detectable through its associated opening, the lines of weakness and the openings each extending continuously from said one marginal edge portion to said second marginal edge portion whereby to provide edge to edge support for each bag as it is loaded with a product.

10. The process of claim 9 wherein the openings are formed after at least one of the securing steps.

11. The process of claim 9 wherein the bag fronts are formed from a second web.

12. The process of claim 9 wherein the bag fronts are preformed prior to connection of the fronts to the web.

13. The process of claim 9 wherein the second side is provided by forming the fronts from the web by folding a front section of the web relative to a back section of the web.

14. The process of claim 9 wherein the second side is provided by securing the fronts to the web.

15. The process of claim 14 wherein the sides are provided by forming seals between the fronts and the web.

16. The process of claim 9 said at least one marginal edge portion is secured to the web by bead seals.

17. The process of claim 9 wherein the bag openings are formed in a front portion of the web and the lines of weakness are formed in a back section of the web and thereafter the web is folded to superpose the front and back sections and form the second side.

18. The process of claim 9 wherein the spacing between each successive pair of fronts longitudinally of the chain of bags being formed is at least about 1/64 inch.

19. A process of forming a chain of preopened interconnected plastic bags comprising:

a) feeding an elongate web along a path of travel;

b) forming longitudinally spaced pairs of longitudinally spaced lines of severance in a bag front section of the web;

c) forming longitudinally spaced lines of weakness in a back section of the web, each line of weakness being transversely aligned with and between and associated pair of lines of severance;

d) folding the web to superpose the sections to form one side edge of each bag being formed;

e) longitudinally securing the superposed sections together at a location spaced from the fold to form another side edge of each bag being formed, the side edges being located such that the lines of weakness extend substantially continuously from the first side edge to the second side edge whereby to provide edge to edge support for each such bag when a product is loaded into it;

f) securing the sections together at longitudinally spaced locations at least certain of which are each near a pair of lines of severance and an associated line of weakness to form bottoms of the bags being formed; and, g) removing portions of the front section each, the portions extending from the first side edge to the second and being between a pair of lines of severance to form access openings in the bags being formed and each opening extending longitudinally in both directions from the associated line of weakness whereby to facilitated detection the lines of weakness during a subsequent packaging operation.

20. The process of claim 19 wherein the securing steps are performed by heat sealing the sections together.

21. The process of claim 19 wherein the portion removal step is performed before the web is folded.

22. The process of claim 19 wherein the portion removal step is performed after the web is folded.

23. A process of making a chain of interconnected, preopened plastic bags comprising:

a) feeding front and back plastic web sections along respective paths of travel;

b) forming spaced, parallel, transversely extending lines of weakness in the back section;

c) forming spaced pairs of transversely extending, spaced lines of severance in the front section at longitudinally spaced intervals corresponding to the longitudinal spacing of the lines of weakness;

d) superposing the sections with each pair of lines of severance positioned with an associated one of the lines of weakness longitudinally located between the lines of severance of an associated pair of the lines of severance;

e) forming spaced, transverse seals between the sections at least certain of the transverse seals delineating bag bottoms each near a line of weakness and its associated pair of lines of severance;

f) forming at least one longitudinally extending first bag side edge seal opposite and spaced from a second side edge delineated by a selected one of a longitudinally extending side fold and a longitudinally extending second side edge seal, the side edges being located such that the lines of weakness extend substantially continuously from the first side edge to the second side edge whereby to provide edge to edge support for each such bag when a product is loaded into it; and, g) forming bag openings extending from one side edge to the other by removing portions of the face section between the lines of severance of each pair and each opening extending longitudinally in both directions from the associated line of weakness whereby to facilitate detection of the lines of weakness during a subsequent packaging operation.

24. A process for forming an elongate chain of interconnected, pre-opened, plastic bags comprising:

a) feeding at least one elongate web section along at least one path of travel;

b) forming from the at least one web an elongate flattened tube having juxtaposed face and back plies;

c) forming a series of spaced, bag bottom delineating, transverse seals between the plies;

d) forming transverse lines of weakness in the back ply spaced from one another at intervals corresponding to the spacing between the seals, each of the lines of weakness being near one of the seals to delineate ends of two contiguous bags being formed, the lines of weakness each extending substantially continuously across the width of the web from a first to a second side edge whereby to provide edge to edge support for each such bag when a product is loaded into it;

e) forming bag openings in the front ply extending from the first to the second side edges, each bag opening being aligned with an associated one of the lines of weakness with each opening extending longitudinally of the web in both directions from its associated line of weakness a distance sufficient to assure detector access to the associated line of weakness; and f) collecting a quantity of the formed interconnected bags.

25. A process according to claim 24, wherein each opening is substantially longitudinally symmetrical of its associated line of weakness.

* * * * *